US005289643A

United States Patent [19]

Jensen

[11] Patent Number: 5,289,643

[45] Date of Patent: Mar. 1, 1994

[54] APPARATUS FOR DRYING A MOIST PARTICULATE MATERIAL WITH SUPERHEATED STEAM

[75] Inventor: Arne S. Jensen, Sovaeget, Denmark

[73] Assignee: Niro A/S, Sorborg, Denmark

[21] Appl. No.: 961,674

[22] PCT Filed: Jul. 8, 1991

[86] PCT No.: PCT/DK91/00197

§ 371 Date: Jan. 5, 1993

§ 102(e) Date: Jan. 5, 1993

[87] PCT Pub. No.: WO92/01201

PCT Pub. Date: Jan. 23, 1992

[30] Foreign Application Priority Data

Jul. 9, 1990 [DK] Denmark ..... 1652/90

[51] Int. Cl.[5] ..... B26B 17/12

[52] U.S. Cl. ..... 34/169; 34/177

[58] Field of Search ..... 34/64, 165, 167, 168, 34/169, 175, 177, 178

[56] References Cited

FOREIGN PATENT DOCUMENTS 0153704 9/1985 European Pat. Off. .

*Primary Examiner*—Henry A. Bennet

*Attorney, Agent, or Firm*—Watson, Cole, Grindle & Watson

[57] ABSTRACT

An apparatus for drying a moist particulate material having a non-uniform particle side with superheated steam includes a cylindrical part wherein a number of parallel, substantially vertical elongated chambers is located in ring form, one or more of the chambers having a closed bottom and the remaining chambers having a steam-permeable bottom, the adjacent chambers being interconnected, and an upper conical part which is also divided into chambers and which at a lower end is connected with the chambers of the cylindrical part of the apparatus, the chambers of the conical part of the apparatus being divided into smaller chambers by inclined guide plates, wherein at least part of each of the inclined guide plates in the conical part of the apparatus is hollow and can be heated by supplying superheated steam hereto.

5 Claims, 5 Drawing Sheets

APPARATUS FOR DRYING A MOIST PARTICULATE MATERIAL WITH SUPERHEATED STEAM

BACKGROUND OF THE INVENTION

1. Field of the Invention

The present invention relates to an apparatus for drying a moist particulate material having a non-uniform particle size with superheated steam, the apparatus including a lower cylindrical part having a number of parallel, substantially vertical elongated chambers located in ring form, one or more of the chambers having a closed bottom and the remaining chambers having a steam-permeable bottom, the adjacent chambers being interconnected through openings in the chamber walls at the lower ends of the chambers, and an upper conical part which is also divided into chambers, which at its lower end is connected to the chambers of the cylindrical part of the apparatus and which at the top is connected to a transfer zone, the chambers of the conical part of the apparatus being divided into smaller chambers by means of inclined guide plates, means for supplying moist particulate material to a chamber having a steam-permeable bottom, means for discharging dried material from a chamber having a closed bottom, means for supplying superheated steam to the area below the steam- permeable chamber bottoms, means for discharging steam from the transfer zone, and means for reheating the discharged steam and recirculating it to the area below the steam-permeable chamber bottoms.

2. The Prior Art

An apparatus of the type mentioned above is known from Zuckerind. 114 (1989) No. 12, pp. 964-70 and EP-A-0153704. This prior art apparatus is particularly suitable for drying beet pulp formed by extracting sugar from sugar beet slices with water, but the apparatus is also suitable for removing liquid, including liquids other than water, from a number of sensitive organic materials.

The prior art apparatus presents the advantage that the particulate material is dried without the access of air, thereby making it possible to avoid oxidation of the material during drying. Another important advantage of the apparatus is that it is environmentally highly acceptable as the drying takes place in a substantially closed system. Furthermore, the excess amount of steam, which, e.g., is generated when drying beet pulp, is very pure and consequently it can be used for the concentration of sugar juice, and the condensate thus formed does not cause odour nuisances as compared to the emission products formed by, e.g., drum-drying beet pulp.

In practical use of the drying apparatus mentioned above it has been found that partially dried particulate material tends to adhere to the oblique guide panels and in particular to the upper sides of these panels and that a gradually increasing coating is formed on the guide plates.

SUMMARY OF THE INVENTION

The object of the invention is to avoid this drawback and according to the invention this object is obtained with an apparatus of the type mentioned above, which apparatus is characterized in that at least part of the oblique guide plates in the conical part of the apparatus is provided with means for heating the plates.

Thus, the invention is based on the discovery that by heating the guide plates mentioned above it is possible to eliminate or at least considerably reduce the tendency of the particulate material to adhere to the upper side of the guide plates. The reason why such an adherence is avoided is unknown but it is assumed that contact with the warm guide plates makes the liquid-containing particles "dance" on the plates in the same manner as water drops on a hot-plate or that a zone of relative hot steam is formed close to the surfaces of the plates, the steam causing the surfaces of the particles to dry.

The oblique guide plates according to the invention are preferably hollow and the interior of the guide plates are connected with means for supplying steam thereto. However, the guide plates may also be heated otherwise, e.g., they may comprise electric heating members.

During use of the apparatus according to the invention the surface temperature of the guide plates is preferably maintained at a value which is 20°–80° C. higher than the saturation point of the steam used in the apparatus at the given pressure. Thus, when using superheated steam having a pressure of 3.7 bars corresponding to a saturation point of 140° C., the temperature of the guide plates is preferably maintained at 160°–220° C.

According to a further embodiment of the invention in which adjacent drying chambers are interconnected through openings in the chamber walls in the transition zone between the conical part and the cylindrical part, the upper sides of the guide plates are provided with guide means. These guide means are preferably placed in such a manner that particulate material which comes into contact with the upper sides of the guide plates is directed towards the openings of the adjacent drying chambers on the downstream side of the apparatus. Such guide means, which, e.g., have the form of metal bars attached to the upper sides of the guide plates, thus support the advancing movement of the particulate material through the apparatus and contribute in reducing the retention time of the material.

When drying a water-containing particulate material superheated steam is used, whereas superheated vapour of the liquid present in the material is used when drying material containing a non-aqueous liquid.

BRIEF DESCRIPTION OF THE DRAWINGS

The invention will now be described in further detail with reference to the drawings in which.

DETAILED DESCRIPTION OF THE PREFERRED EMBODIMENTS

Figure 1:
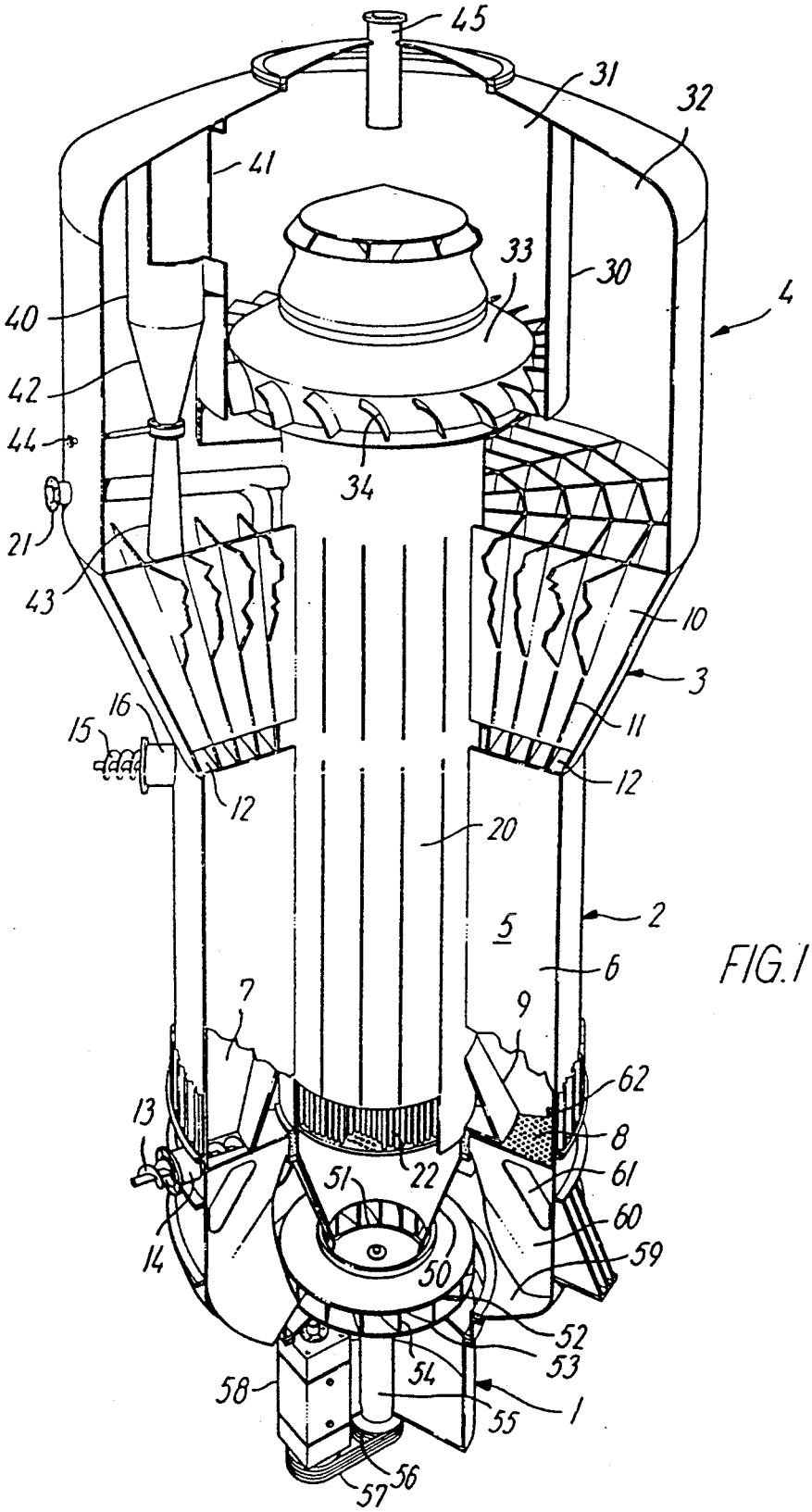
FIG. 1 shows a perspective and partially sectional view of a preferred embodiment of an apparatus according to the invention.

The apparatus shown in the drawings comprises a bottom part generally designated 1, a cylindrical part generally designated 2, a conical part generally designated 3 and a top part generally designated 4.

The cylindrical part 2 is divided into fifteen drying chambers 6, which are connected in series, by means of vertical chamber walls 5, and a discharge chamber 7 is located between the first and the last drying chamber 6. At the bottom the drying chambers 6 are delimited by a perforated chamber bottom 8 and a spacer element 9 is located centrally above the chamber bottom 8, the spacer element having an upper side which inclines downwardly and outwardly and an underside which is located a short distance above the perforated chamber bottom 8. The drying chambers 6 extend into the conical part 3 of the apparatus, each drying chamber 6 being divided into downwardly-tapering smaller chambers 10 by inclined guide plates 11 which are connected with heating members (not shown). Adjacent drying chambers 6 and the discharge chamber 7 are interconnected in the transition zone between the cylindrical part 2 and the conical part 3 via openings 12 in the chamber walls 5.

A screw conveyor 13 which is mounted rotatably in a discharge pipe 14 is located at the bottom of the discharge chamber 7. The upper portion of the cylindrical part 2 of the apparatus is provided with a corresponding screw conveyor 15 located in a feed pipe 16 debouching into the upper portion of the first drying chamber 6.

A pipe heat exchanger 20 fills the central portions of the cylindrical part 2, the conical part 3 and in part the top part 4, the heat exchanger being connected to a pipe 21 for supplying superheated steam which, as explained below, is passed from the top part 4 to the bottom part 1 of the apparatus via a large number of heat exchanger pipes 22 while at the same time being heated by the superheated steam supplied through the pipe 21. Furthermore, the heat exchanger 20 is connected to a pipe (not shown) for discharging condensate from the area around the pipes of the heat exchanger 22.

The top part 4 is divided into a central chamber 31 and a transfer chamber 32 by means of a plate 30. A stationary filling element 33 is provided in the central chamber at the upper end of the heat exchanger 20, the outside of the filling element 33 being provided with a number of guide blades 34 having such a shape and spacing that a cyclone field is formed in the space within the plate 30 by steam passing from the transfer chamber 32 up through the space between the filling element 33 and the plate 30.

The plate 30 abuts with a cyclone 40 and the central chamber 31 is connected with the interior of the cyclone 40 through an opening 41 in the plate 30 and in the cyclone 40. The latter has a conical lower portion 42 passing into a slightly funnel-shaped portion 43 debouching into one of the chambers 10 in the discharge chamber 7. In the transition zone between the conical lower portion 42 and the funnel-shaped portion 43 a pipe 44 is provided for supplying a gas under pressure to produce an ejector effect in the transition zone between the lower conical portion 42 of the cyclone and the funnel-shaped portion 43.

A pipe 45 for discharging excess steam is provided at the top of the top part 4 of the apparatus.

The bottom part 1 of the apparatus comprises a funnel-shaped portion 50 extending downwardly from the lowermost end of the heat exchanger 20 into the interior of a centrifugal blower 51 comprising a rotor consisting of two circular plates 52 and 53 having blades 54 mounted between the plates.

The rotor 51 is mounted on a shaft 55 having a wedge belt gear 56 which drives a motor 58 via a pair of V-belts 57. The rotor 51 is surrounded by a steam distribution chamber 59 wherein guide panels 60 having holes 61 formed therein are located.

Figure 2:
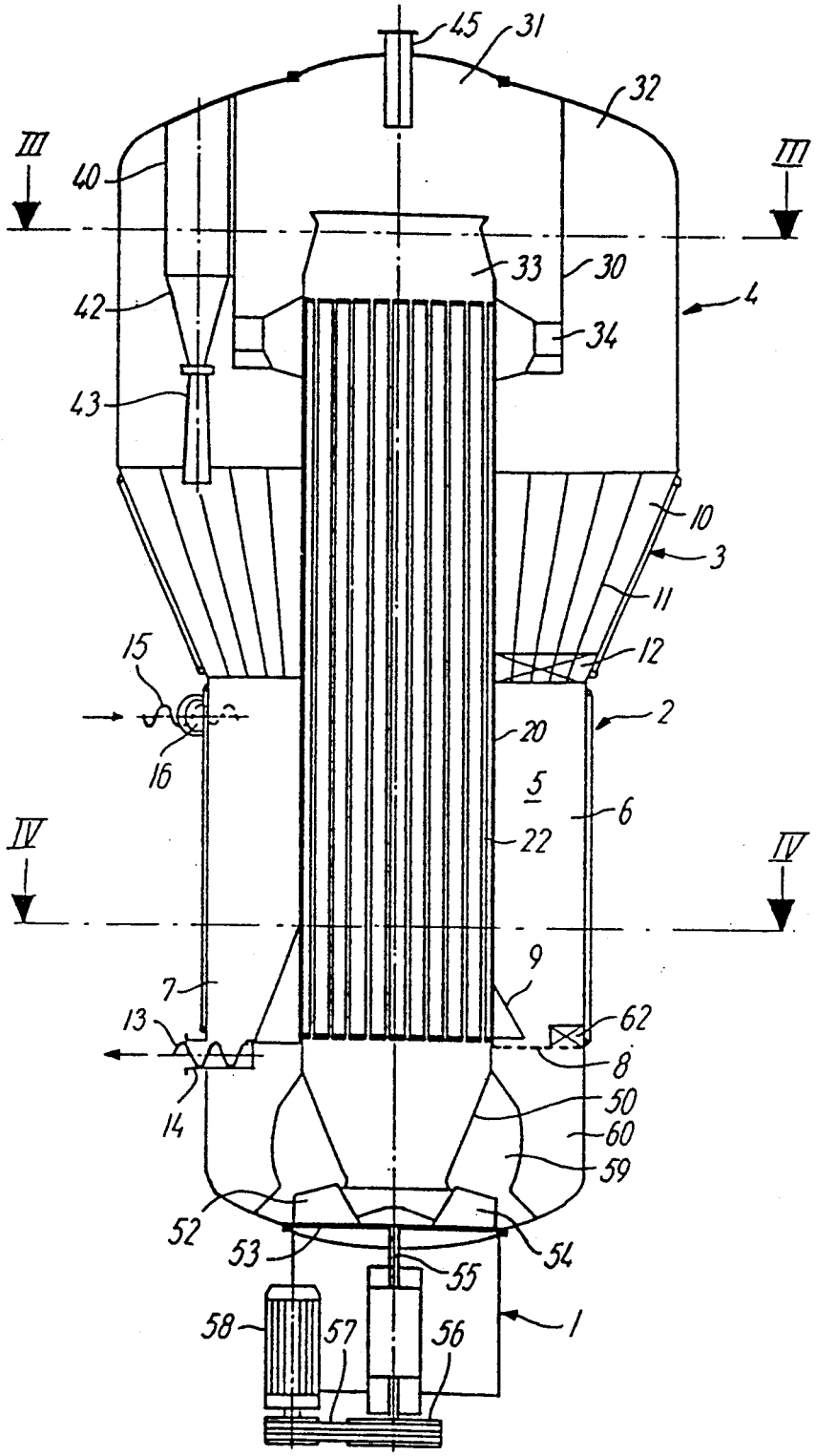
FIG. 2 shows a vertical sectional view of an apparatus according to FIG. 1.
Figure 3:
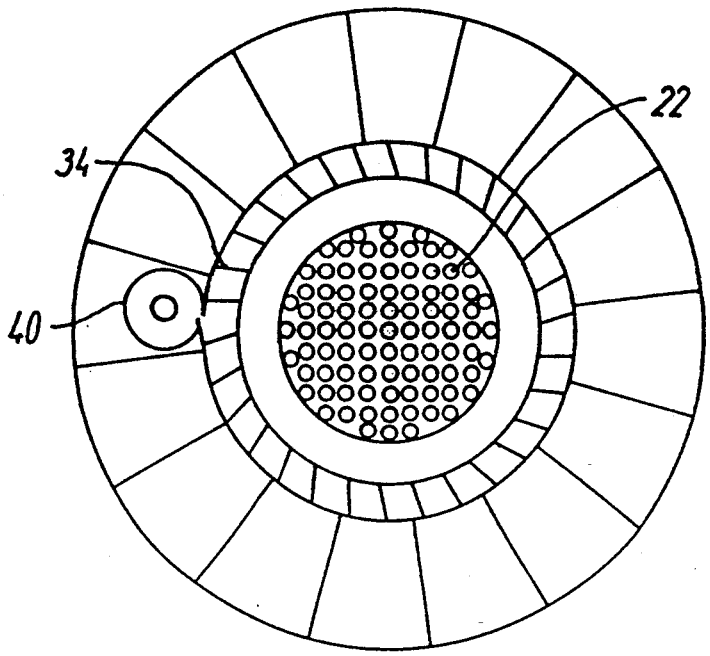
FIG. 3 shows a horizontal sectional view along the line III—III through the apparatus according to FIG. 1.
Figure 4:
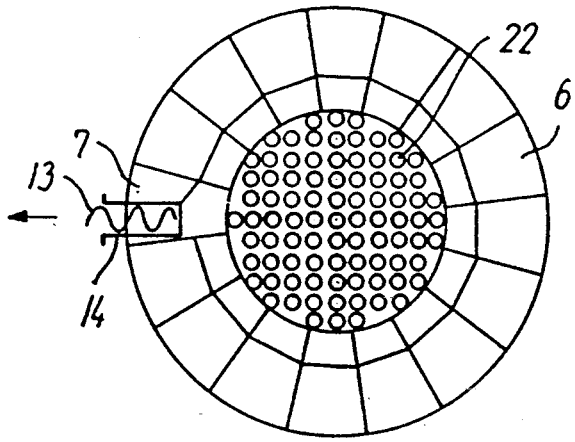
FIG. 4 shows a horizontal sectional view along the line IV—IV through the apparatus according to FIG. 1.
Figure 5:
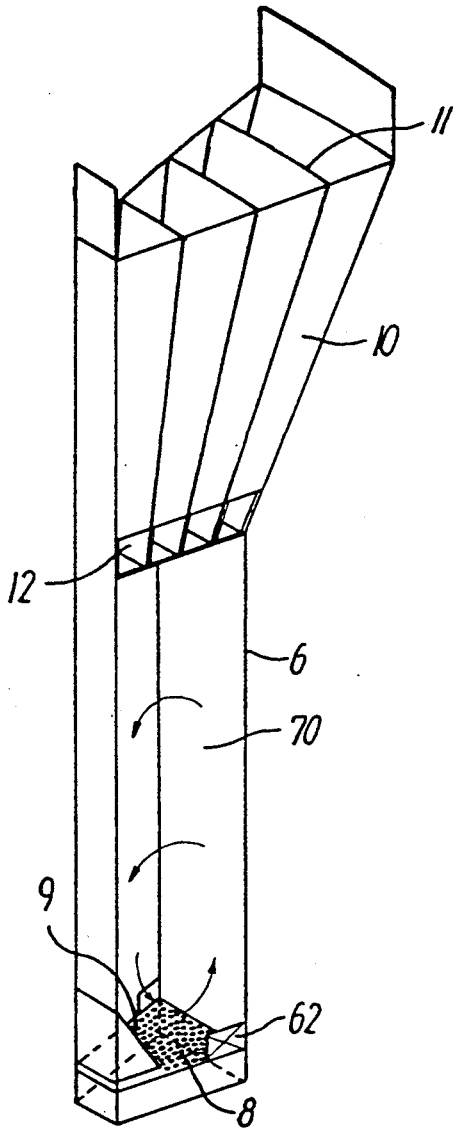
FIG. 5 shows a schematic perspective view of a drying chamber of an apparatus according to the invention.

As will appear from FIGS. 1, 2 and 5 the chamber walls 5 of the drying chambers 6 are provided with holes 62 through which non-dried material can pass from one drying chamber 6 to another. These holes 62 or some of the holes decrease in size in the flow direction of the material.

Figure 6:
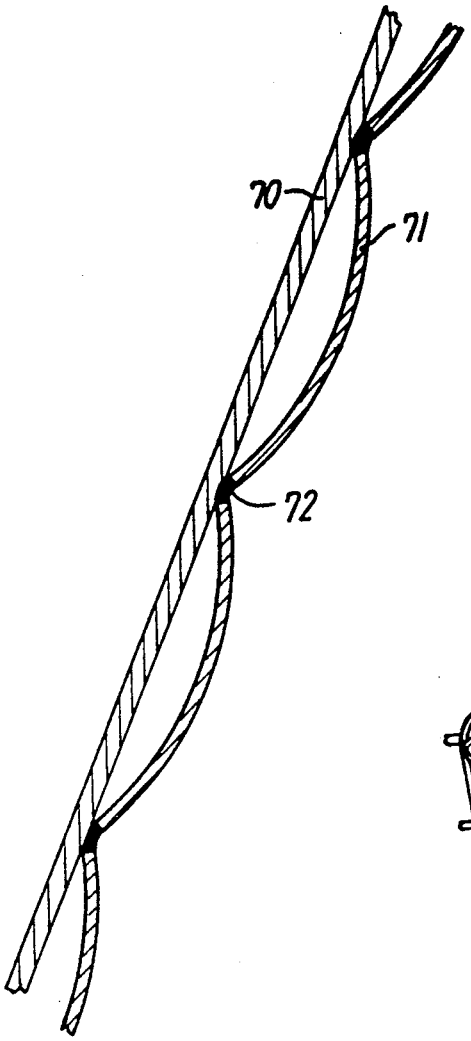
FIG. 6 shows a vertical sectional view of an oblique guide plate in a preferred embodiment of the apparatus according to the invention and FIG. 7 shows a perspective view of the upper side of an inclined guide plate in another preferred embodiment of an apparatus according to the invention.

As will appear from FIG. 6, the inclined guide plates 11 may comprise a front plate 70 and a corrugated rear plate 71 welded to the front panel 70 in separate zones 72. The guide plate 11 shown is connected with a steam pipe (not shown) for supplying superheated steam and a discharge pipe (not shown) for discharging condensate and steam.

Figure 7:
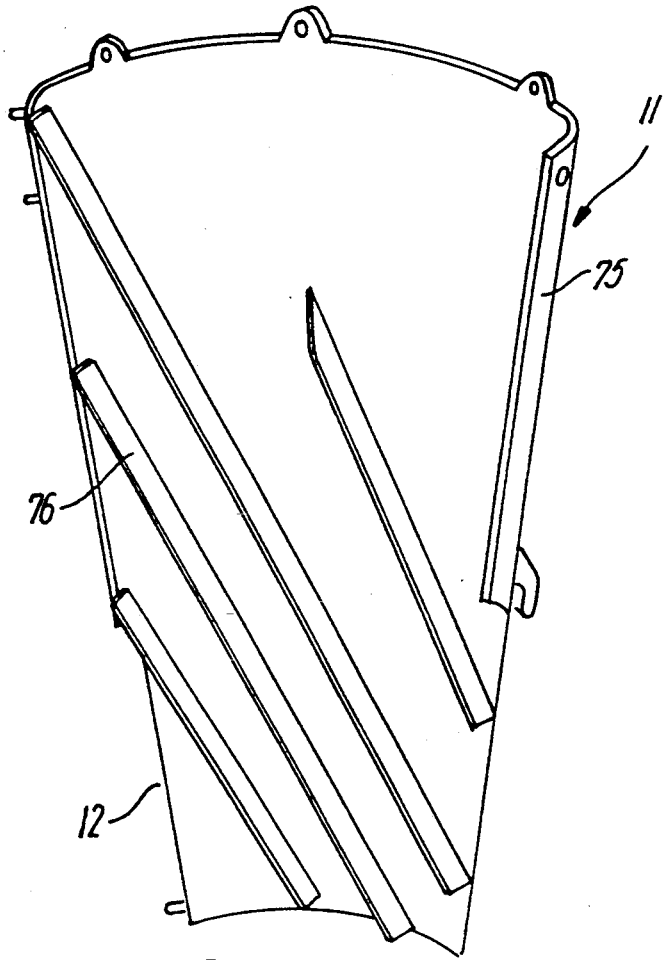

The upper side of the guide plate 11 shown in FIG. 7 is provided with two side flanges 75 and four guide bars 76 which are located in such a manner that particulate material moving down across the upper side of the guide plate is directed towards one of the side flanges 75, the lowermost portion of the side flange being cut away to form a hole 12 to the adjacent drying chamber 6.

The apparatus operates in the following way:

Particulate starting material is conveyed into the upper portion of the first of the drying chambers 6 connected in series by means of the screw conveyor 15 and the feed pipe 16. In the drying chamber the material introduced is subjected to the influence of superheated steam which is introduced into the drying chamber through the perforated bottom 8. The spacer elements 9 impart a whirling movement to the material as shown in FIG. 5. Part of the material will be too heavy to remain suspended and will move towards the chamber bottom 8. During the downward movement which primarily takes place in the central part of the chamber, the material will hit the upper side of the spacer element 9 and slide down this side.

When reaching the chamber bottom 8 after passing down the inclined upper side of the spacer element 9, part of this relatively coarse material will pass into the next (second) drying chamber 6 via the hole 62 in the chamber wall 5.

The relatively coarse material introduced into the second drying chamber 6 will be directed towards the third drying chamber in the same manner, and so on.

During the drying of the material in the chambers 6 the particles will gradually lose weight and the lightest particles will pass up into the conical part 3 of the apparatus. Having reached that part of the apparatus, part of the material will settle on the upper side of the guide plates 11 where the upward-moving gas flow is weak. Hence the material will be further heated and dried, and in a dried state it will slide down towards the cylindrical part 2 of the apparatus. When guide bars 76 are located on the upper side of the guide plates 1 as shown in FIG. 7, the dry material will be directed towards the openings 12 and into a subsequent chamber.

The large particles will preferably remain in the lowermost portion of the chambers 6.

In practice it has been found that more than 90% of the material (on a dry matter basis) is conveyed through the openings 62 at the lower ends of the chambers and through the openings 12 in the transition zone, between the conical part 3 and the cylindrical part 2. Thus, only a relatively small part of the material passes into the transfer zone and the greater part of this passes up into the central chamber 31.

There will be no upward-moving flow of steam in the area above the discharge chamber 7 because the bottom of this chamber is closed, and when passing into the discharge chamber 7 the dry particles will move towards the bottom of this chamber.

The material which is introduced into the discharge chamber 7 through the holes 62 at the lowermost ends of the drying chambers, through the openings 12 in transition zone between the cylindrical part 2 and the conical part 3 or through the transfer chamber 32 is discharged at the bottom of the discharge chamber 7 by means of the screw conveyor 13 mounted in the discharge pipe 14.

From the transfer chamber 32 the flow of steam from the drying chamber 6 will pass up into the central chamber 31 and thereby pass the guide blades 34 which impart a whirling movement to the flow of steam along the inner side of the plate 30, thereby causing entrained particles to be directed towards the plate 30, and on passing the opening 41 the particles will be introduced into the cyclone 40, wherein they will settle at the bottom of the cyclone, and from the cyclone they will be introduced into the discharge chamber 7 by the supply of gas through the pipe 44.

The steam liberated from solid particles is pumped from the central chamber 31 down through the heat exchanger 20 by means of the centrifugal blower 51. During the passage through the heat exchanger 20 the steam is superheated by means of steam or another heating medium which is supplied to the heat exchanger 20 through the pipe 21.

The flow of steam generated in the centrifugal blower 51 is passed through the steam distribution chamber 59 into the area below the perforated chamber bottoms 8 of the drying chambers 6 and from this area up into the drying chambers 6.

Excess steam generated by evaporation of liquid from the particulate material is discharged through the pipe 45 at the top part 4 of the apparatus.

I claim:

1. An apparatus for drying a moist particulate material having a non-uniform particle size with superheated steam, said apparatus comprising a lower cylindrical part (2) having a number of parallel, substantial vertically elongated chambers (6, 7) located in ring form, one or more of the chambers (7) having a closed bottom and the remaining chambers (6) having a steam-permeable bottom (8), the adjacent chambers (6) being interconnected through openings (62) in the chamber walls (5) at the lower ends of the chambers (6), and an upper conical part (3) which is also divided into chambers (10), which at its lower end is connected to the chambers (6) of the cylindrical part (2) of the apparatus and which at the top is connected to a transfer zone (32), the chambers of the conical part (3) of the apparatus being divided into smaller chambers (10) by means of inclined guide plates (11), means (15) for supplying moist particulate material to a chamber (6) having a steam-permeable bottom, means (13) for discharging dried material from a chamber (7) having a closed bottom, means (51) for supplying superheated steam to the area below the steam-permeable chamber bottoms (8), means (51) for discharging steam from the transfer zone, and means (20) for reheating the discharged steam and recirculating it to the area below the steam-permeable chamber bottoms (8), characterized in that at least part of the inclined guide pates (11) in the conical part (3) of the apparatus is provided with means (70, 71) for heating the plates (11).

2. An apparatus according to claim 1, characterized in that the guide plates (11) are hollow and provided with means for supplying steam to the interior of the plates.

3. An apparatus according to claim 1 comprising adjacent drying chambers (6) which are interconnected through openings (12) in the chamber walls (11) in the transition zone between the conical part (3) and the cylindrical part (2) of the apparatus, characterized in that the upper sides of the guide plates (11) are provided with guide means (76).

4. An apparatus according to claim 3, characterized in that the guide means (76) are disposed in such a manner that particulate material on the upper sides of the guide plates (11) is directed towards the openings (12) of the adjacent drying chambers on the down-stream side of the apparatus.

5. An apparatus according to claim 3, characterized in that the guide means (76) comprise metal bars attached to the upper sides of the guide plates (11).

* * * * *